United States Patent [19]

Tartakovsky

[11] 4,206,622

[45] Jun. 10, 1980

[54] HELICAL ROLLING MILL ROLL LINE FOR PRODUCING DIE-ROLLED SECTIONS AND SOLIDS OF REVOLUTION

[76] Inventor: Igor K. Tartakovsky, ulitsa Sovetskaya, 2, kv. 102, Elektrostal; Moskovskaya oblast, U.S.S.R.

[21] Appl. No.: 928,592

[22] Filed: Jul. 27, 1978

[51] Int. Cl.[2] ..... B21B 13/00

[52] U.S. Cl. ..... 72/95; 72/98

[58] Field of Search ..... 72/95, 98, 101, 249, 72/195, 96, 97

[56] References Cited

U.S. PATENT DOCUMENTS

| | | | |
|---|---|---|---|
| 1,669,879 | 5/1928 | Morris et al. | 72/195 |
| 2,627,767 | 2/1953 | Batchelder | 72/101 |

*Primary Examiner*—Lowell A. Larson

*Attorney, Agent, or Firm*—Lackenbach, Lilling & Siegel

[57] ABSTRACT

Output shafts of a pinion stand are connected with rolls of a working stand by means of spindles provided with a shaft whose ends are formed with Hooke's joints. The angles of obliquity of the shafts of the spindles are similar for all the joints of the spindles. The axes of the output shafts of the pinion stand are equidistant from the axis of rolling. The angular space relationship of the pinion stand with the working stand, i.e. the angle of inclination of the plane, passing through the axis of rotation of the output shafts and through geometrical axis of the pinion stand, to the plane passing through the axis of rolling and through the axis of a variable angle of rolling, is determined by a formula.

2 Claims, 5 Drawing Figures

HELICAL ROLLING MILL ROLL LINE FOR PRODUCING DIE-ROLLED SECTIONS AND SOLIDS OF REVOLUTION

BACKGROUND OF THE INVENTION

1. Field of the Application

The present invention relates to metal working, and more particularly to mills for helical rolling of solids of revolution, as well as for die rolling.

The invention is especially suitable for application in rolling mills wherein the rolls mounted in a working stand are provided with a group drive.

2. Description of the Prior Art

A rolling mill roll line coventionally comprises an electric motor, a reducer, a pinion stand the output shafts of which are connected with the rolls of a working stand by means of spindles. The rolling mill roll line scheme mentioned above is universally adopted in the art, including the mills for helical rolling. A pinion stand usually comprises a split housing, the split parts of which are bolted together and are formed with recesses to receive therein one driven and two driving pinion shafts intended to impart rotation to the rolls mounted in a working stand. The transmission of rotation to the size rolls mounted in the working stand is effected by means of spindles, especially by the so-called universal spindles widely employed in modern rolling mills. This type of universal spindle comprises an intermediate shaft, two ends of which are provided with universal joints or Hooke's joints which consist of two forks interconnected with a cross piece. The universal spindles are provided in the rolling mill roll line to ensure reliable transmission of rotation moment to the working rolls, the efficiency of said spindles being rather high and their dimensions relatively small, with the axis of the spindle intermediate shaft forming together with the axis of a roll an angle variable within the range of 12 to 15 deg.

It has been found that uniform rotation of the working rolls is ensured when the transmission ratio of the spindle joints are equal to one. The term "transmission ratio of the spindle joints" is used herein to denote the ratio of the rotational speeds of the driven and driving shafts (of the working roll and of the pinion stand shaft). This will be possible if $\alpha_1'=\alpha_2'$ and $\Psi=\lambda$, where:

$\alpha_1'$ is the angle of obliquity in a universal joint connected with the working roll shaft, i.e. the angle between the axis of the spindle intermediate shaft and the axis of a roll;

$\alpha_2'$ is the angle of obliquity in a universal joint connected with a pinion stand i.e. the angle between the axis of the spindle intermediate shaft and the axis of the pinion stand;

$\Psi$ is the angle of turn of the yokes of the spindle intermediate shaft, the yokes should be made to turn in the direction of swivel of the planes of the axes of the spindle joints;

$\lambda$ is the angle between the planes of the axes of the single universal couplings, positioned at a working and pinion stand.

The plane of the axes of the couplings is used to denote the plane which comprises two intersecting axes of a universal coupling (cf. "Vestnik Machinostroenia"-/Engineering News, Moscow Publishers, 1965, No. 5, pp. 25–28).

It has been found in the course of theoretical and practical research that the provision of a group drive in rolling mills is by far not sufficient to ensure similar dynamic and kinematic characteristics for each roll in the zone of deformation, and such is essential for a reliable, efficient and high-quality process of rolling.

OBJECTS OF THE INVENTION

It is an object of the invention to provide a rolling line of a mill for helical and die rolling, wherein the appropriate selection of the basic design parameters for the rolling mill roll line will ensure equal angles of obliquity in all the couplings of all the spindles.

Another object of the invention is to attain high operating reliability and enhanced production efficiency in a rolling mill of the type mentioned above, as well as ensuring high-quality rolled products made therewith.

These and other objects of the invention are accomplished by the provision of a helical rolling mill roll line for producing die-rolled sections and solids of revolution, comprising a working stand with rolls arranged at a preset angle of rolling, a pinion stand the output shafts of which are connected with said working stand rolls through respective spindles each made in the form of a shaft having its ends provided with couplings, according to the invention, the shafts of the spindles are disposed at the same angle of obliquity formed in all the couplings of all the spindles, the axes of the output shafts of the pinion stand being equidistant from the axis of rolling, with the plane passing through the axes of rotation of the output shafts and through geometrical axis of the pinion shaft being inclined to the plane passing through the axis of rolling and through the axis of a variable angle of rolling at an angle $\nu$ calculated by the following formula:

$$\sin \nu=(l_1+l_2)/R \text{ tg } \phi/2, \quad (I)$$

where $l_1$ is the distance from the center of a working stand to the center of a coupling, measured along the axis of a roll;

$l_2$ is the distance from the center of the working stand to the center of another coupling, measured along the axis of rolling;

$\phi$ is the angle of rolling;

R is the radius of circumference passing through the axes of the output shafts of the pinion stand.

The equality of angles in all the couplings of the spindle is required to provide for uniform dynamic and kinematic characteristics for all the rolls, which makes it possible to diminish axial and tangential sliding of metal with respect to the rolls, thereby permitting the production efficiency of the equipment to be enhanced and the quality of the rolled products to be improved.

BRIEF DESCRIPTION OF THE DRAWINGS

The invention will be further described in terms of its specific embodiment intended for producing balls, with reference to the accompanying drawings, wherein.

DESCRIPTION OF THE PREFERRED EMBODIMENT

Figure 1:
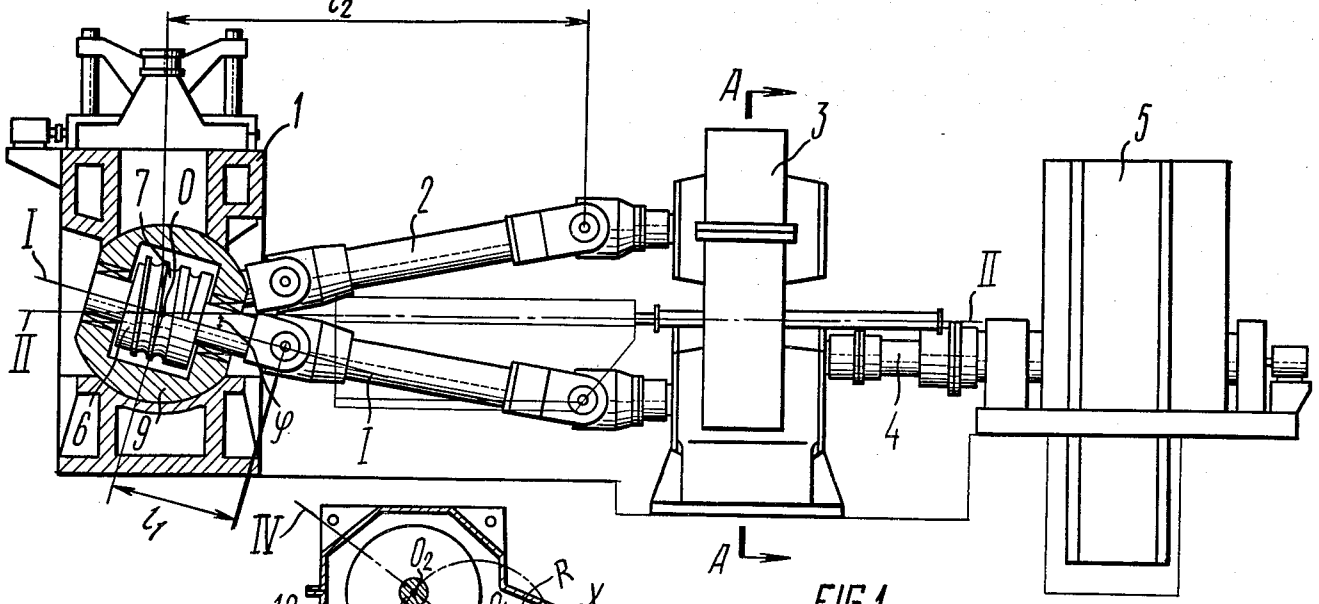
FIG. 1 is a general view of a roll line of a two-high ball-rolling mill.

Referring now to the drawings in detail, and to FIG. 1 in particular, there is shown therein a ball-rolling mill roll line which comprises a working stand I, universal spindles 2, a pinion stand 3, a main spindle 4 and an electric motor 5.

Figure 2:
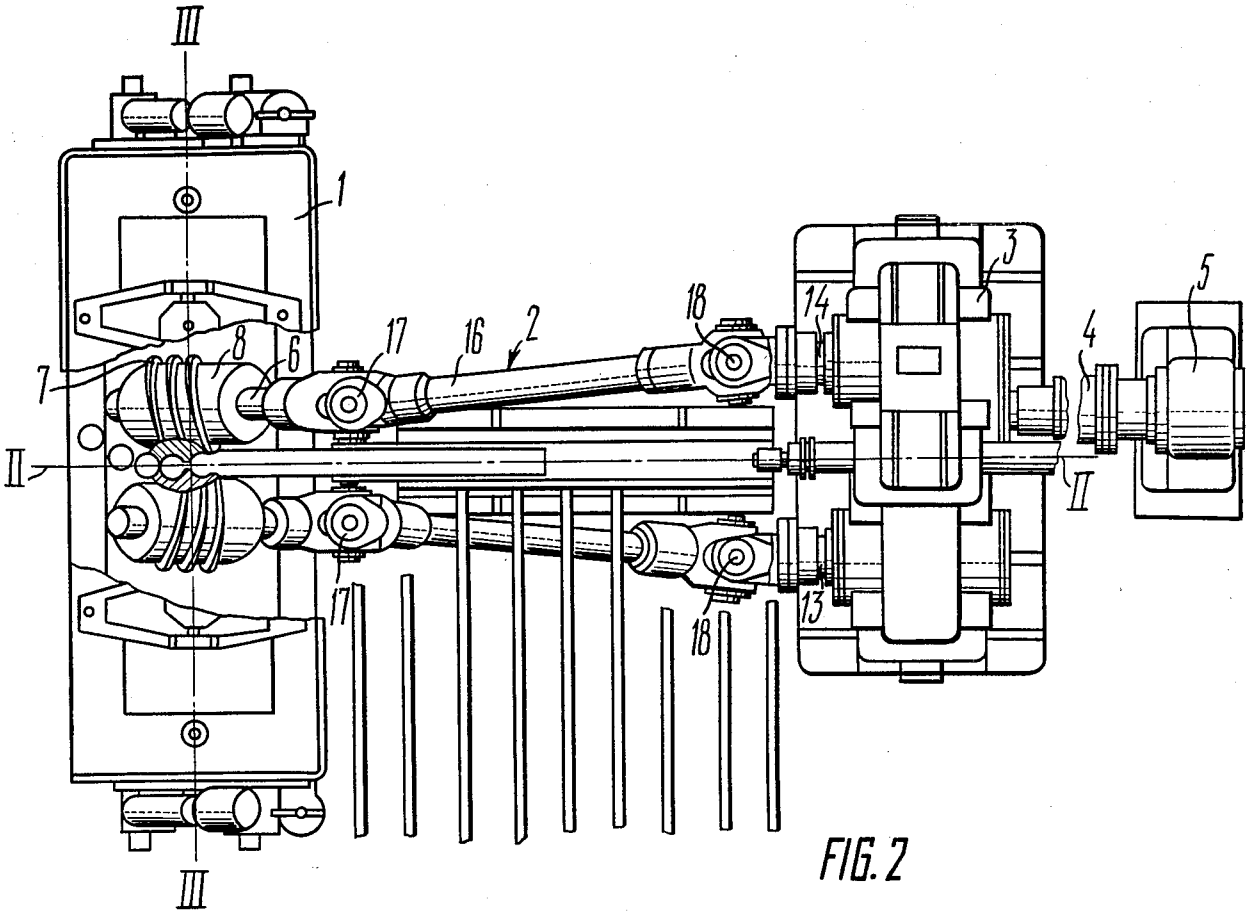
FIG. 2 is a plan view of FIG. 1.

The working stand I is provided with rolls 6 which are arranged at an angle $\phi$ of rolling, i.e. the angle formed between the axis I—I of the rolls 6 and the axis II—II of rolling. The rolls have their bodies 8 grooved at 7, such as shown in FIGS. 1 and 2, and are positioned in rotary drums or blocks 9. The feed angle of the rolls 6 is altered by turning the block about the working stand geometrical center O which is disposed at the point of intersection of the axis II—II of rolling and the axis III—III of a variable angle of rolling. It will be apparent that the working stand may be variously otherwise embodied depending on the type of the product being rolled, and on the process and design specifications.

Figure 3:
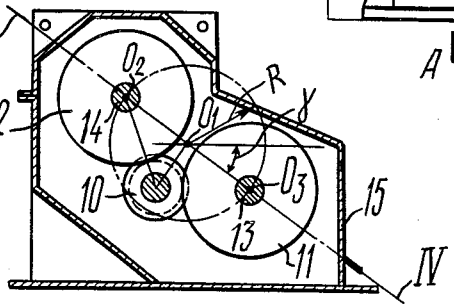
FIG. 3 is a cross-section taken along plane A—A in FIG. 1.

The pinion stand 3 comprises a driving pinion 10 and two driven pinions 11 and 12, such as shown in FIG. 3, mounted on output shafts 13 and 14 and placed in a housing 15. The pinion stand is positioned so that its geometrical center $O_I$, lying in the middle of the section $O_2O_3$ of the axis IV—IV passing through the centers of the pinion stand output shafts, is found on the axis of rolling.

The universal spindle 2 consists of an intermediate shaft 16 and of universal couplings 17 and 18 mounted on the end of said shaft. The universal couplings also known as "Hooke's couplings" are known to those skilled in the art and are formed as two yokes which are interconnected by means of a cross piece and a sliding or antifriction bearing. Needless to say that any other bearings can be used, such as ball bearings having the same number of degrees of freedom as the Hooke's couplings.

The coupling 17 of the upper spindle, as viewed in the drawing, is coupled to the axle of the roll 6, and the coupling of the lower spindle, as viewed in the drawing, is coupled to the axle of the other roll 6. The coupling 18 of the upper spindle, as viewed in the drawing, is coupled to the output shaft 14 of the pinion 12 of the pinion shaft 3, and the coupling 18 of the lower spindle, as viewed in the drawing, is coupled to the output shaft 13 of the pinion stand 3.

In accordance with the invention the axes of the output shafts should be equidistant from the axis of rolling. The angles $\alpha$ of obliquity in all the couplings of all the spindles should be equal to one another. The yokes of the couplings, provided Hooke's couplings are used, should form an angle $\phi$ determined by the following formula:

$$\cos\phi=(\cos^2\alpha-\cos\phi)/\sin 2\alpha \qquad (2)$$

The angular space relationship of the pinion stand and working stand, determined by the angle $\nu$ i.e. by the angle of inclination of the plane, passing through the axis of rotation of the output shafts and through geometrical axis of the pinion stand, to the plane passing through the axis of rolling and through the axis of a variable angle of rolling, makes it possible to ensure, the center of the pinion stand being brought in coincidence with the axis of rolling, uniform gearing and dynamic operating conditions at both rolls.

Figure 5:
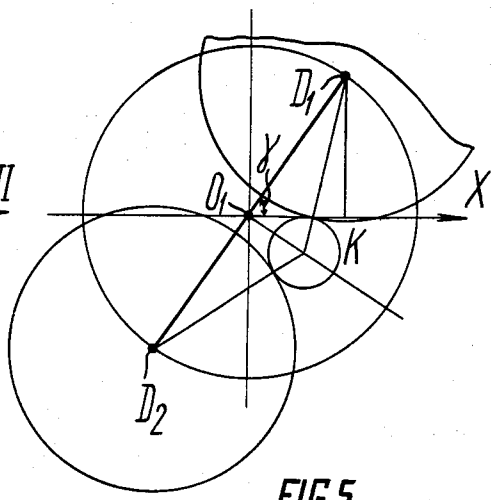
FIG. 5 shows a gearing of a pinion stand.
Figure 4:
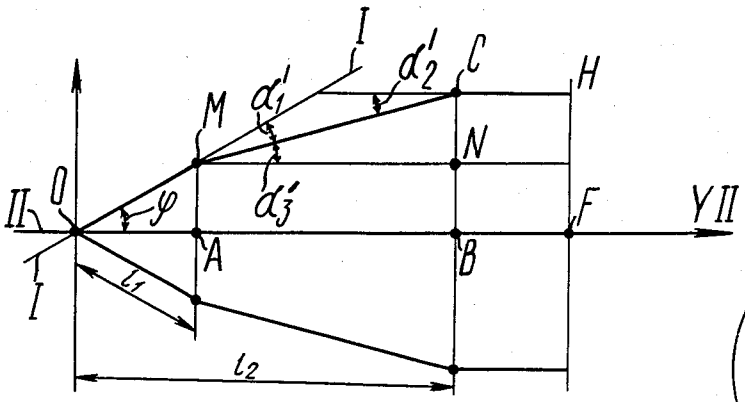
FIG. 4 schematically illustrates a gearing system of a rolling mill roll line.

To determine the value of angle $\nu$ reference is made to FIGS. 4 and 5. For a preset angle $\phi$ of rolling, $OM=1_I$, $OB=1_2$, MC is the axis of the spindle, CH is the axis of the output shaft of the pinion stand 3, $O_I$. $D_I=R$ $$\phi=\alpha_1'+\alpha_3'=\alpha_1'+\alpha_2'=2\alpha_1',$$

consequently $$\alpha_1'=\phi/2=\alpha_3'$$

$$D_1K = HF = BN + NC = MA + NC = MA + MN\cdot \mathrm{tg}\,\alpha_3' = MA + (OB - OA)\cdot \mathrm{tg}\frac{\phi}{2} = l_1\sin\phi + (l_2 - l_1\cos\phi)\mathrm{tg}\frac{\phi}{2} = l_1\sin\phi + l_2\mathrm{tg}\frac{\phi}{2} - l_1\cos\phi\cdot \mathrm{tg}\frac{\phi}{2} = l_1(\sin\phi - \cos\phi\cdot \mathrm{tg}\frac{\phi}{2}) + l_2\mathrm{tg}\frac{\phi}{2} = l_1\cos\phi(\mathrm{tg}\phi - \mathrm{tg}\frac{\phi}{2}) + l_2\mathrm{tg}\frac{\phi}{2} = l_1\cos\phi\frac{\sin(\phi-\frac{\phi}{2})}{\cos\phi\cdot \mathrm{co}\frac{\phi}{2}} + l_2\mathrm{tg}\frac{\phi}{2} = l_1\mathrm{tg}\frac{\phi}{2} + l_2\mathrm{tg}\frac{\phi}{2} = (l_1+l_2)\cdot \mathrm{tg}\frac{\phi}{2};$$

$$\sin\gamma = \frac{D\cdot K}{O_1\cdot D} = \frac{l_1+l_2}{R}\cdot \mathrm{tg}\frac{\phi}{2}.$$

The manner of operation of the rolling mill of the invention is not herein described since it is similar to that of the prior art mills used for similar purposes.

It should be observed, however, that with the rolling mill roll line according to the present invention it is possible to enhance production efficiency and improve the quality of the rolled products by way of reducing the coefficient of non-uniformity of rotation of the working rolls.

Various modifications may be made in the invention without departing from the spirit of the following claims.

I claim:

1. In a roll line of a mill for helical and die rolling, comprising a working stand with rolls arranged at a preset angle of rolling, a pinion stand the output shafts of which are connected with said working stand rolls through respective spindles each being made in the form of a shaft having its ends provided with couplings, so that the shafts of the spindles are mounted in said couplings at an angle of obliquity relative to the axes of the rolls, the improvement consisting in that the shafts of the spindles are mounted at the same angle of obliquity in all the couplings of all the spindles, the axes of said output shafts of the pinion stand being equidistant from the axis of rolling, with the plane passing through the axes of rotation of the output shafts and through geometrical axis of the pinion shaft being inclined to the plane passing through the axis of rolling and through the axis of a variable angle of rolling at an angle $\nu$ calculated by the following formula:

$$\sin\nu=(1_1+1_2)/R\ \mathrm{tg}\ \phi/2, \qquad (I)$$

where $1_I$ is the distance from the center of a working stand to the center of a coupling measured along the axis of a roll;

$l_2$ is the distance from the center of a working stand to the center of another coupling, measured along the axis of rolling;

$\phi$ is the angle of rolling;

R is the radius of the circumference passing through the axes of the output shafts of the pinion stand.

2. A rolling mill roll line as claimed in claim I, wherein each spindle is formed as an intermediate shaft provided with the Hooke's coupling, the fork members of said shafts being spaced apart to form an angle $\Psi$ determined by the following formula:

$$\cos \Psi = (\cos^{2\alpha} - \cos^{\phi})/\sin^{2\alpha} \quad (2)$$

where $\alpha$ is the angle of obliquity;

$\phi$ is the angle of rolling.

* * * * *